United States Patent [19]

Takashima et al.

[11] Patent Number: 4,771,855

[45] Date of Patent: Sep. 20, 1988

[54] BACKHOE VEHICLE

[75] Inventors: Akira Takashima; Shizuo Shimoie, both of Sakai, Japan

[73] Assignee: Kubota Ltd., Osaka, Japan

[21] Appl. No.: 114,164

[22] Filed: Oct. 27, 1987

[30] Foreign Application Priority Data

May 15, 1987 [JP] Japan ..... 62-73189[U]
Jun. 1, 1987 [JP] Japan ..... 62-85988[U]
Jun. 19, 1987 [JP] Japan ..... 62-94731[U]

[51] Int. Cl.[4] ..... B60K 26/00; B62D 1/02

[52] U.S. Cl. ..... 180/326; 180/329; 180/331; 180/89.13

[58] Field of Search ..... 180/326, 329, 331, 89.13, 180/89.12

[56] References Cited

U.S. PATENT DOCUMENTS 3,891,003 6/1975 Duttarer et al. ..... 180/329
4,059,171 11/1977 Pakosh ..... 180/329
4,274,503 6/1981 Mackintosh ..... 180/329
4,467,604 8/1984 Forster ..... 180/329

FOREIGN PATENT DOCUMENTS 218426 9/1986 Japan .
2099767 12/1982 United Kingdom ..... 180/329

*Primary Examiner*—Kenneth R. Rice
*Attorney, Agent, or Firm*—Jordan and Hamburg

[57] ABSTRACT

A backhoe vehicle comprising an engine and a driver's seat disposed rearwardly of an oil passage defining rotary joint of a swivel platform rotatably mounted through bearings on a stationary support of a chassis, a swivel guide gear attached to the stationary support, a swivel pinion meshed with the swivel guide gear, a motor for driving the swivel pinion to rotate the swivel platform, and traveling control valves and backhoe control valves mounted in a control box disposed on the swivel platform forwardly of the rotary joint. The motor is disposed below the traveling control valves and the backhoe control valves. The backhoe vehicle further comprises a driver's deck having a bent configuration with step portions thereof disposed laterally of the rotary joint being at a lower level than a cover portion disposed over the rotary joint.

4 Claims, 6 Drawing Sheets

BACKHOE VEHICLE

BACKGROUND OF THE INVENTION (1) Field of the Invention

The present invention relates to a small backhoe vehicle, and more particularly to a backhoe vehicle comprising an engine and a driver's seat disposed rearwardly of an oil passage defining rotary joint of a swivel platform rotatably mounted through bearings on a stationary support of a chassis, a swivel guide gear attached to the stationary support, a swivel pinion meshed with the swivel guide gear, a motor for driving the swivel pinion to rotate the swivel platform, and traveling control valves and backhoe control valves mounted in a control box disposed on the swivel platform forwardly of the rotary joint.

(2) Description of the Prior Art

As shown in FIG. 10 of the accompanying drawings, a known backhoe vehicle of this type comprises a swivel platform 4 rotatable by a motor M3 disposed between a rotary joint 9 and an engine 8.

Such an arrangement has the following inconvenience. Where the vehicle is designed to have a reduced length from a swivel axis P to the rear end of the swivel platform 4, a driver's seat 15 must be disposed at a high level. With the reduction of the length from the swivel axis P to the rear end of the swivel platform 4, the spacing between the engine 8 and rotary joint 9 is reduced. Then it is necessary to dispose the motor M3 laterally away from the center of the swivel platform 4 in order to avoid interference between the motor M3 and the engine 8 or hydraulic pumps P1 and P2 and other implements associated with the engine 8. Consequently, the motor M3 inevitably is disposed under the driver's foot. The motor M3 and rotary joint 9 extend from the bottom of the swivel platform 4 upwardly to a relatively high level. This requires a driver's deck covering the motor M3 and rotary joint 9 to include step portions or foot rests for the driver located at a high level as shown in FIG. 11.

SUMMARY OF THE INVENTION

The object of the present invention is to provide a small backhoe vehicle comprising a swivel platform having small longitudinal dimensions with a driver's seat located at a low level. The invention intends to provide such a backhoe vehicle which is simple in construction, and is therefore manufactured with high productivity and at low cost.

In order to achieve the above object, a backhoe vehicle according to the present invention comprises a motor disposed below traveling control valves and backhoe control valves, and a driver's deck having a bent configuration with step portions thereof disposed laterally of the rotary joint being at a lower level than a cover portion disposed over a rotary joint.

According to the above construction in which the motor is disposed below the control valves, the engine may be disposed adjacent the rotary joint to minimize the length from the swivel axis to the rear end of the swivel platform, and it is not necessary to increase the length from the swivel axis to the front end of the swivel platform in order to secure a space for accommodating the motor. The motor may be assembled into the swivel platform to permit the cover portion of the driver's deck to have a reduced width and the right and left step portions to be located at a low level, so that the cover portion is situated between the two feet resting on the step portions.

Consequently, the invention allows the backhoe vehicle to have reduced longitudinal dimensions by reducing the length from the swivel axis to the rear end of the swivel platform and keeping the longitudinal dimensions of the swivel platform to a minimum. In addition, the vehicle now has a reduced height with the driver's seat located at a low level. This results in a compact overall construction of the vehicle, which facilitates operation and storage of the vehicle in a relatively small space. This feature is of great advantage of excavating operations carried out in small urban spaces or in orchards or the like where trees grow close together. Furthermore, the backhoe vehicle according to the present invention is not complicated in construction, and is therefore manufactured with high productivity and at low cost.

Other advantages of the invention will be apparent from the description of the preferred embodiments to follow.

BRIEF DESCRIPTION OF THE DRAWINGS

FIGS. 1 through 9 illustrate a backhoe vehicle embodying the present invention, in which:

FIG. 1 is a plan view showing the position of a prime mover,

FIG. 2 is a front view of a section including control valves,

FIG. 3 is a side view of a driver's section,

FIG. 4 is a sectional view of a rotary joint and a swivel deck mounting structure, FIG. 5 is a section taken on line V—V of FIG. 4, FIG. 6 is a side elevation of the backhoe vehicle including an earth-moving implement, FIG. 7 is a sectional view of a rotary joint and a swivel deck mounting structure according to another embodiment, FIG. 8 is a plan view of a principal portion of FIG. 7, and FIG. 9 is a section taken on line IX—IX of FIG. 7.

DETAILED DESCRIPTION OF THE PREFERRED EMBODIMENTS

A backhoe vehicle embodying the present invention will be described in detail with reference to the drawings.

Figure 6:
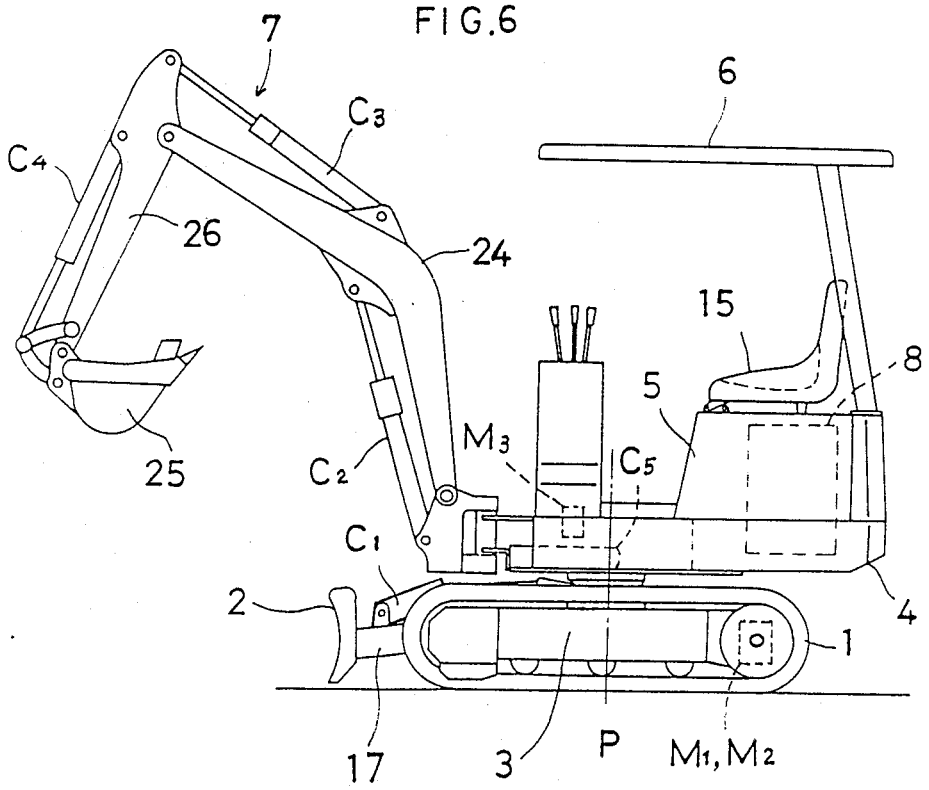

As shown in FIG. 6, the backhoe vehicle comprises a chassis 3 including crawler traveling devices 1 and an earth-moving implement 2, and a swivel platform 4 mounted on the chassis 3. The swivel platform 4 carries a prime mover section having a bonnet 5, a driver's section having a sunshade 6, and a backhoe implement 7.

Figure 1:
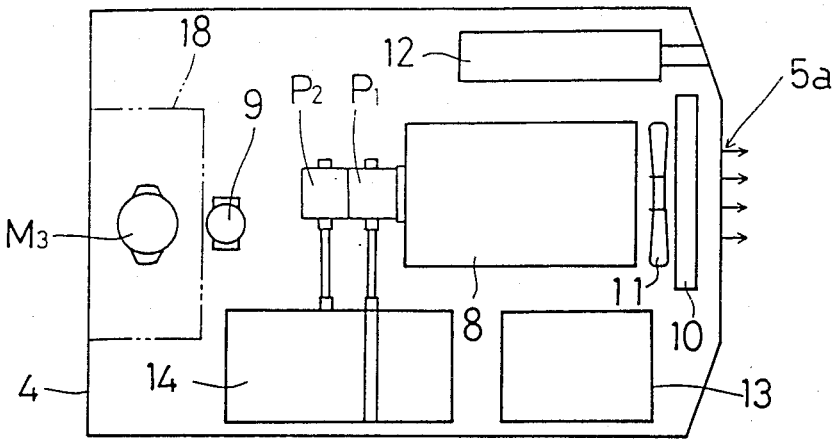
Figure 3:
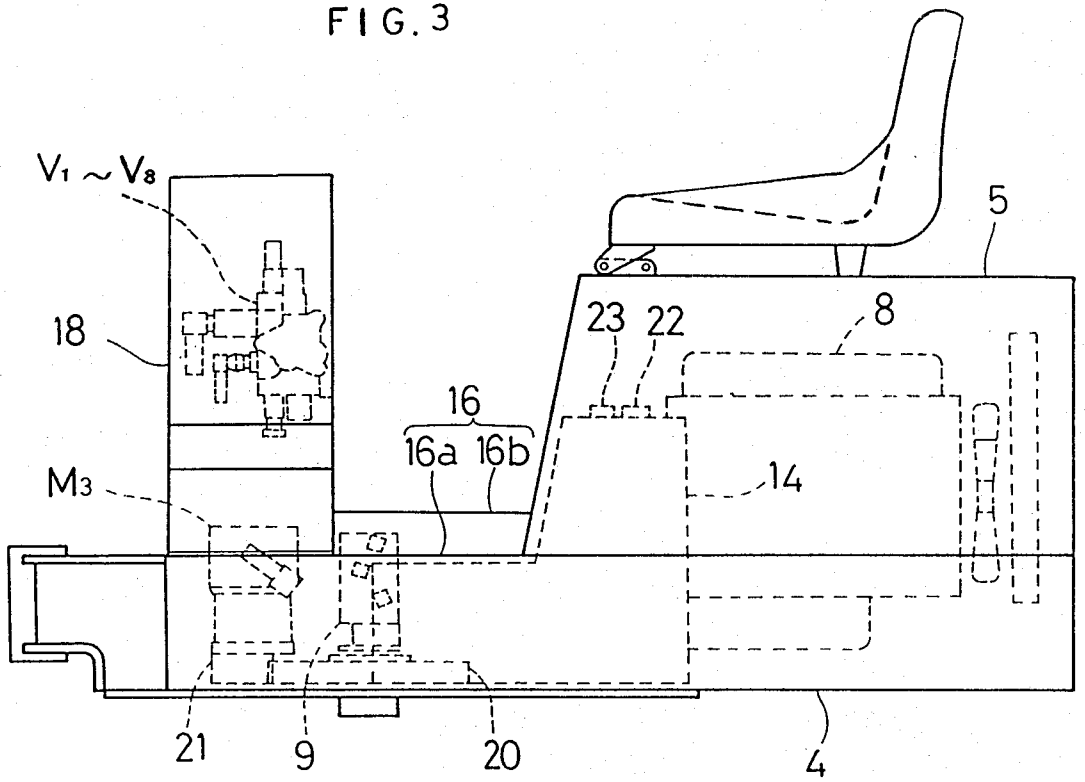
Figure 4:
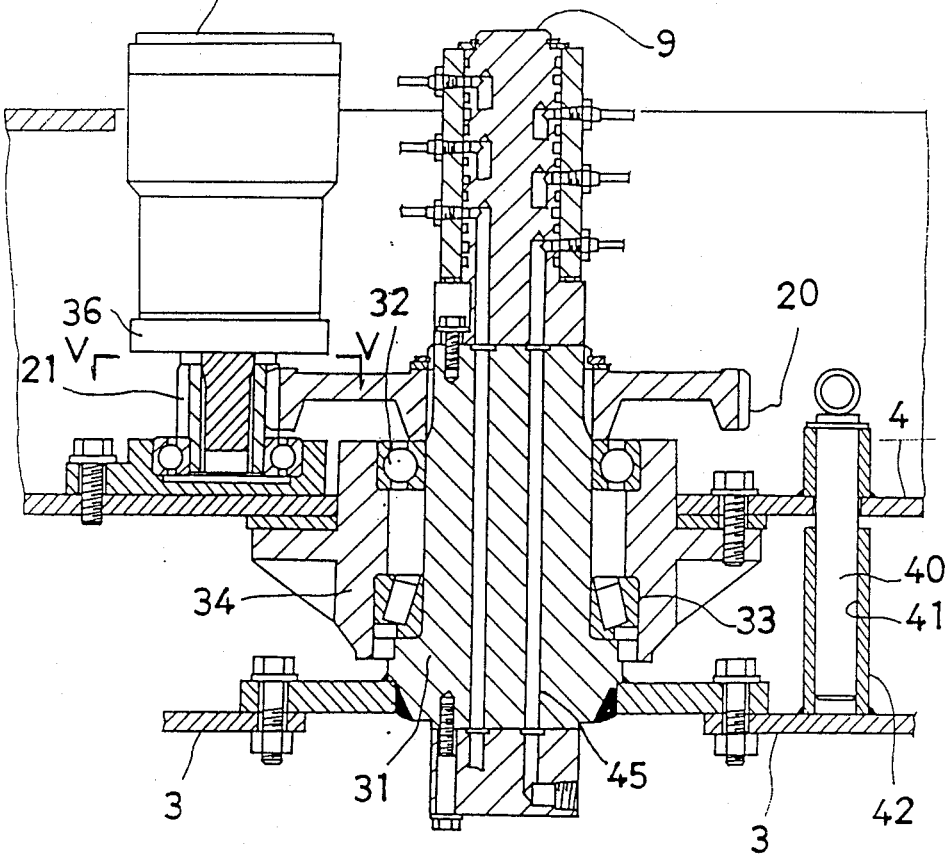
Figure 5:
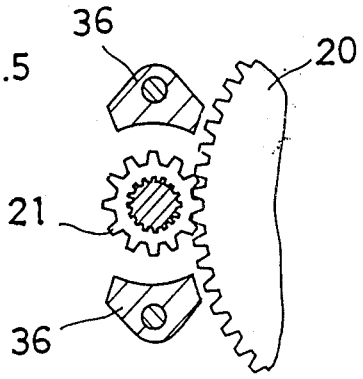

As shown in FIGS. 1 and 3, the prime mover section includes an engine 8 disposed rearwardly of a rotary joint 9 of the swivel platform 4 shown in FIG. 4. An engine cooling radiator 10 and a fan 11 for supplying cooling air to the radiator 10 are disposed rearwardly of the engine 8. Reference 5*a* indicates positions of vents defined in the bonnet 5. An exhaust muffler 12 of the engine 8 and a fuel tank 13 are disposed at opposite sides rearwardly of the engine 8. Hydraulic pumps P1 and P2 are disposed forwardly of the engine 8 to be driven by the engine 8 to deliver pressure oil from an oil tank 14 to hydraulic actuators described later.

The driver's section includes a driver's seat 15 disposed rearwardly of the rotary joint 9 and mounted on the engine bonnet 5, and a driver's deck 16 disposed forwardly of the bonnet 5. A control box 18 is mounted on the swivel platform 4 forwardly of the rotary joint 9. The control box 18 includes a pair of traveling control valves V1 and V2 connected through the rotary joint 9 to a pair of traveling hydraulic motors M1 and M2 attached to the chassis 3 for driving the crawler traveling devices 1, a bulldozer control valve V3 connected through the rotary joint 9 to a hydraulic cylinder C1 for raising and lowering the earth-moving implement 2 by vertically oscillating a bulldozer arm 17, four backhoe control valves V4-V7 connected respectively to a hydraulic cylinder C2 for driving a boom 24 of the backhoe implement 7, a hydraulic cylinder C3 for driving an arm 26 of the backhoe implement 7, a hydraulic cylinder C4 for driving a bucket 25 connected to the arm 26 and a hydraulic cylinder C5 for swinging the backhoe implement 7, and a swivel control valve V8 connected to a hydraulic motor M3 attached to the swivel platform 4 for causing its swiveling movement.

As shown in FIGS. 1 through 5, the hydraulic motor M3 is attached to the swivel platform 4 at a position below the eight control valve V1–V8, to swivel the swivel platform 4 by driving a swivel pinion 21 meshed with a swivel guide gear 20.

The swivel platform 4 is attached to the chassis 3 as shown in FIG. 4. This attachment structure includes a stationary support 31 extending upwardly from the chassis 3, and a bearing retainer 34 attached to the swivel platform 4. The bearing retainer 34 surrounds the stationary support 31 to be rotatable relative thereto through upper and lower bearings 32 and 33 spaced apart from each other in the direction of a swivel axis of the swivel platform 4. The swivel guide gear 20 is fixed to an upper position of the stationary support 31, and the swivel pinion 21 on the swivel platform 4 is meshed with the guide gear 20. The swivel pinion 21 is driven by the hydraulic motor M3 to swivel the swivel platform 4. The stationary support 31 defines passages 45 therein for delivering pressure oil.

Figure 2:
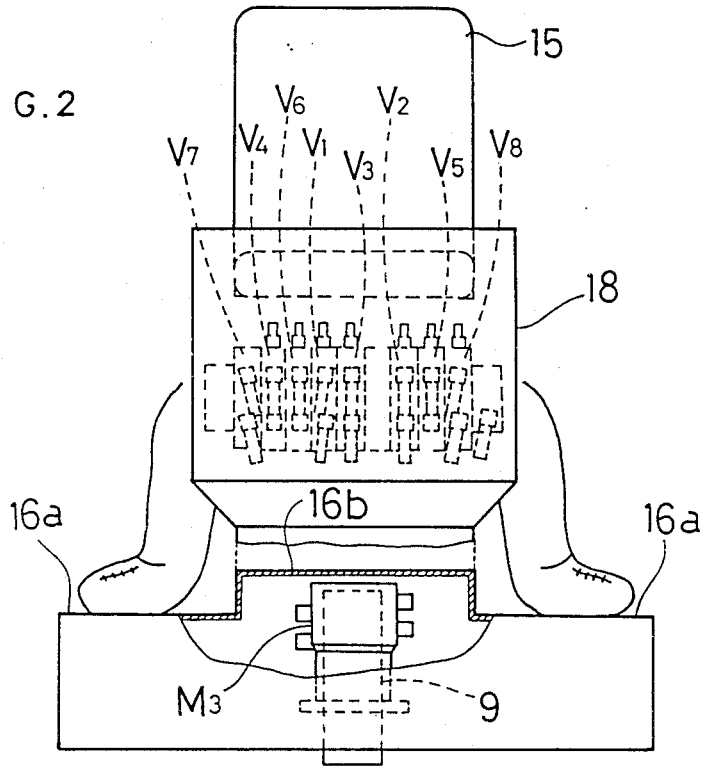

As shown in FIGS. 2 and 3, the driver's deck 16 is attached to the swivel platform 4 in a bent form. The deck includes right and left step portions **16*a* opposed to each other across the rotary joint 9 for the driver to rest his feet, and a cover portion 16*b* over the rotary joint 9, the step portions 16*a* being at a lower level than the cover portion 16*b***.

As shown in FIG. 3, the oil tank 14 includes a forward tank portion having a low vertical level and extending to a position under the driver's deck 16, and a rearward tank portion having a higher vertical level than the forward tank portion and extending into the engine bonnet 5. The oil tank 14 has an oil inlet 22 and a breather 23 disposed on the rearward tank portion so that oil does not easily flow out when the vehicle becomes inclined.

On the other hand, the chassis 3 includes a swivel lock mechanism for fixing the swivel platform 4 to a forwardly facing position and a rearwardly facing position. As shown in FIG. 4, this swivel lock mechanism includes a lock pin 40 attached to the swivel platform 4 for locking the swivel platform 4, and tubular portions 42 extending upwardly from the chassis 3 defining engaging members 41 engageble with the lock pin 40.

The foregoing construction realizes a backhoe vehicle having a compact swivel deck about 750 mm wide and 1,200 mm long, for example.

Another embodiment will be described next with reference to FIGS. 7 through 9. The illustrated swivel lock mechanism includes two engaging bores 41 extending through the swivel guide gear 20 at positions spaced away from each other 180 degrees around the swivel axis, and a lock pin 40 attached to a connecting frame 4C of the swivel platform 4 to be vertically slidable between a lock position to engage the engaging bores 41 and a release position to disengage therefrom. The swivel platform 4 is fixed to a forward facing position when the lock pin 40 engages one of the engaging bores 41, and to a rearward facing position when the lock pin 40 engages the other engaging bore 41. The lock pin 40 includes a hook 44 at an upper end thereof for controlling the lock pin 40 and retaining the lock pin 40 in the release position by engaging a tube 43 extending upwardly from the connecting frame 4C.

Figure 8:
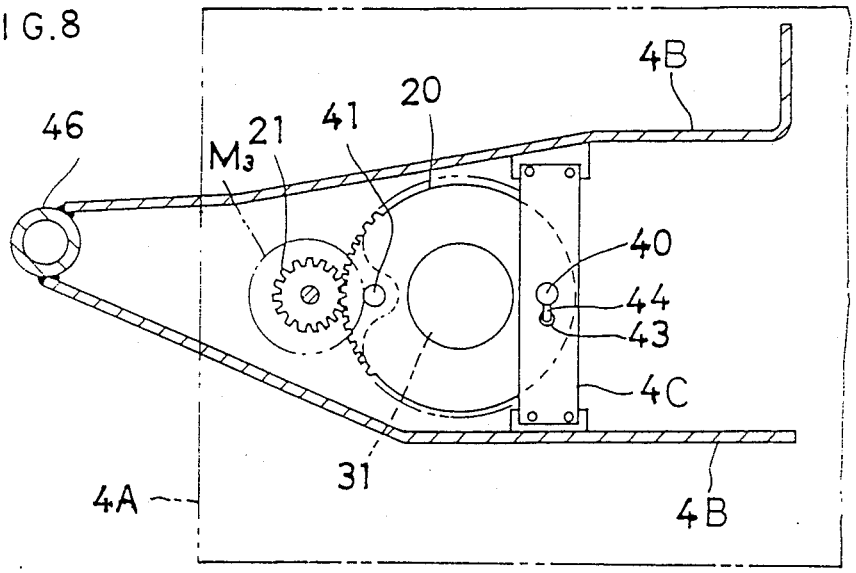

As shown in FIG. 8, the swivel platform 4 includes a pair of right and left reinforcing frames 4B fixed to an upper surface of a main frame 4A to which the bearing retainer 34 is attached. These reinforcing frames 4B are interconnected by the connecting frame 4C which is in a plate form and extends over the swivel guide gear 20. The reinforcing frames 4B are bent inwardly at forward positions thereof, and a boom mounting bracket 46 is fixed to forward ends of the reinforcing frames 4B.

The stationary support 31 is attached to the chassis 3 with a sufficient strength and has a sufficient rigidity since the support 31 functions to swivellably support the swivel platform 4 by properly maintaining the meshing engagement between the swivel guide gear 20 fixed to the upper position of the stationary support 31 and the swivel pinion 21 attached to the swivel platform 4. Further, the swivel guide gear 20 fixed to the upper position of the stationary support 31 and disposed adjacent the swivel platform 4 also is attached to the stationary support 31 with a sufficient strength and has a sufficient rigidity since the swivel guide gear 20 functions to allow the swivel platform 4 to swivel through the meshing engagement with the swivel pinion 21. Having regard to the fact that the engaging portion of the chassis 3 comprises the swivel guide gear 20 having a sufficient rigidity and a sufficient attachment strength, the described lock mechanism readily assures the strength required of the engaging portion for swivel locking. It may be said that this lock mechanism requires no measure to secure strength by providing reinforcing elements or by employing a strong structure.

Consequently, the swivel lock mechanism for a backhoe vehicle according to the present invention has a simple and inexpensive construction capable of effecting swivel locking without any structural weakness.

In the foregoing embodiment, the two engaging bores 41 are provided to lock the swivel platform 4 to the forwardly facing position and the rearwardly facing position. However, the number of such bores is variable. Further, in the foregoing embodiment, the engaging bores 41 are formed by perforating the swivel guide gear 20. Instead of this construction, recesses may be formed in the upper surface of swivel guide gear 20 or engaging members may be fixed to the swivel guide gear 20. Alternatively, teeth of the swivel guide gear 20 may act as engaging members.

Figure 7:
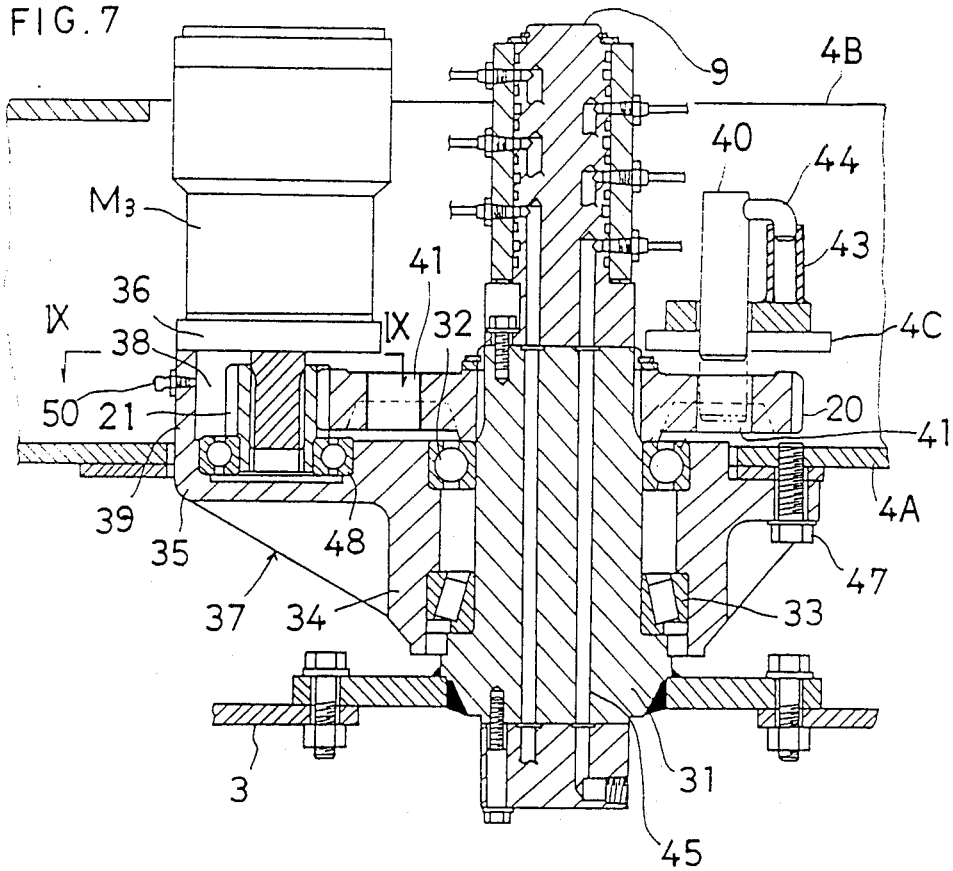
Figure 9:
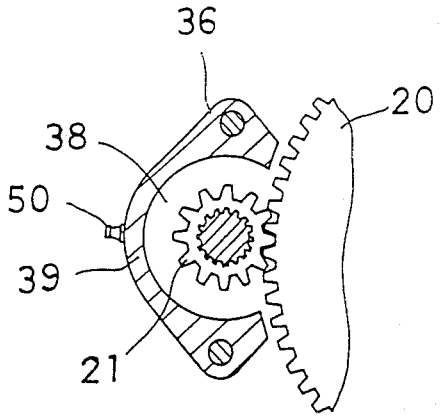
Figure 10:
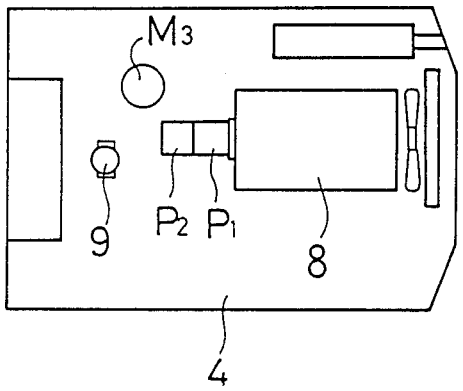
FIG. 10 (PRIOR ART)
FIG. 10 is a plan view showing the position of a prime mover according to the prior art.
Figure 11:
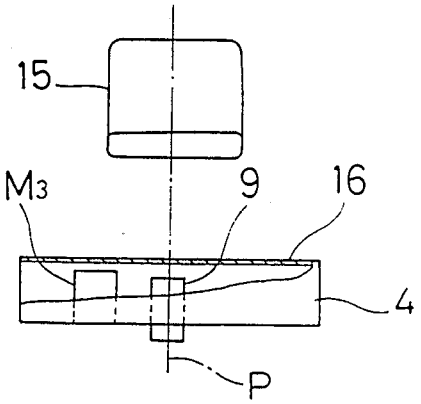
FIG. 11 (PRIOR ART)
FIG. 11 is a front view of a driver's section according to the prior art.

As shown in FIGS. 7 and 9, the swivel platform 4 of this backhoe vehicle is attached to the stationary support 31 of the chassis 3 through a pair of upper and lower bearings 32 and 33 mounted in a bearing retainer 34 defined by a retainer defining member 37 formed by casting and attached to the swivel platform 4 by bolts 47. The swivel guide gear 20 is splined to an upper position of the stationary support 31 to be unrotatable relative thereto. The swivel pinion 21 meshed with the swivel guide gear 21 is mounted, to be rotatable through a bearing 48, in a gear retainer 35 defined by the retainer defining member 37 of the swivel platform 4. The swivel pinion 21 is driven by a hydraulic motor M3 mounted on a motor retainer 36 defined by the retainer defining member 37 of the swivel platform 4. Thus, the swivel pinion 21 is rotatable by the hydraulic motor M3 to swivel the swivel platform 4.

The retainer defining member 37 includes a wall portion 39 laterally surrounding the swivel pinion 21 and defining a grease holder 38 with the swivel pinion 21. The grease holder 38 receives grease through a grease nipple 50 and retains the grease to facilitate smooth rotation of the swivel pinion 21 and to reduce noise due to the meshing engagement between the swivel pinion 21 and the swivel guide gear 20. It will be understood that the present invention allows the grease holder 38 to be formed in the same manufacturing process as the formation of the described retainers 34, 35 and 36.

Compared with the construction of FIG. 4, this construction permits all of the bearing retainer 34, gear retainer 35 and motor retainer 36 to be manufactured and assembled into the swivel platform 4 in a single process by manufacturing and assembling a single retainer defining member 37. Consequently, the component defining all of the bearing retainer 34, gear retainer 35 and motor retainer 36 may be manufactured and assembled with high efficiency in forming the swivel platform 4. This improves the productivity of backhoe vehicle manufacture.

It is of course possible to incorporate only one of the swivel lock mechanism and the retainer defining member shown in FIG. 7 into the construction shown in FIG. 4.

What is claimed is:

1. A backhoe vehicle comprising;

an engine (8) and a driver's seat (15) disposed rearwardly of an oil passage defining rotary joint (9) of a swivel platform (4) rotatably mounted through bearings (32, 33) on a stationary support (31) of a chassis (3), a swivel guide gear (20) attached to said stationary support (31), a swivel pinion (21) meshed with said swivel guide gear (20), a motor (M3) for driving said swivel pinion (21) to rotate said swivel platform (4), and traveling control valves (V1, V2) and backhoe control valves (V4, V5, V6, V7) mounted in a control box disposed on said swivel platform (4) forwardly of said rotary joint (9), wherein said motor (M3) is disposed below said traveling control valves (V1, V2) and said backhoe control valves (V4, V5, V6, V7), and wherein said backhoe vehicle further comprises a driver's deck (16) having a bent configuration with step portions (16*a*) thereof disposed laterally of said rotary joint (9) being at a lower level than a cover portion (16*b*) disposed over said rotary joint (9).

2. A backhoe vehicle as claimed in claim 1 wherein said swivel platform (4) includes a single retainer defining member (37) defining a bearing retainer (34) for retaining said bearings (32, 33), a gear retainer (35) for retaining said swivel pinion (21), and a motor retainer (36) for retaining said motor (M3).

3. A backhoe vehicle as claimed in claim 2 wherein said retainer defining member (37) includes a wall portion (39) laterally surrounding said swivel pinion (21) and defining a grease holder (38) with said swivel pinion (21).

4. A backhoe vehicle as claimed in claim 1 wherein said swivel guide gear (20) defines engaging means (41) engagable with a lock pin (40) vertically slidable between a lock portion for locking said swivel platfrom (4) and a release position.

* * * * *